US006499139B1

(12) United States Patent
Brown et al.

(10) Patent No.: US 6,499,139 B1
(45) Date of Patent: Dec. 31, 2002

(54) FACE GUARD

(75) Inventors: Chrisanthia Brown, Overland Park, KS (US); Billie Jean Smith, Olathe, KS (US)

(73) Assignee: 13-31-Sport, Inc.

( * ) Notice: Subject to any disclaimer, the term of this patent is extended or adjusted under 35 U.S.C. 154(b) by 0 days.

(21) Appl. No.: 09/683,485

(22) Filed: Jan. 7, 2002

(51) Int. Cl.[7] ..... A42B 1/00; A42B 7/00
(52) U.S. Cl. ..... 2/9; 2/421
(58) Field of Search ..... 2/9, 424, 425, 2/421

(56) References Cited

U.S. PATENT DOCUMENTS

| | | | | | |
|---|---|---|---|---|---|
| 200,358 | A | * | 2/1878 | Thayer | 2/9 |
| 652,196 | A | * | 6/1900 | Shibe | 128/858 |
| 1,060,220 | A | * | 4/1913 | White | |
| 1,843,585 | A | * | 2/1932 | Van Orman | 2/9 |
| 2,100,553 | A | * | 11/1937 | Schutt | 2/9 |
| 2,535,434 | A | * | 12/1950 | Marietta | 2/9 |
| 2,627,602 | A | * | 2/1953 | Goldsmith | 2/9 |
| 4,173,795 | A | * | 11/1979 | Lundin et al. | 2/425 |
| 5,267,353 | A | * | 12/1993 | Milligan | 2/424 |
| 5,335,371 | A | | 8/1994 | Spessard | |
| 5,392,465 | A | * | 2/1995 | Shou | 2/7 |
| 5,483,699 | A | * | 1/1996 | Pernicka et al. | 2/424 |
| 5,661,849 | A | * | 9/1997 | Hicks | 2/424 |
| 5,737,770 | A | * | 4/1998 | Chen | 2/9 |
| 5,806,101 | A | | 9/1998 | Thurwanger et al. | |
| 5,911,308 | A | | 6/1999 | Chafitz et al. | |
| 5,933,869 | A | | 8/1999 | Allen | |
| 6,012,164 | A | | 1/2000 | Deal, III | |
| 6,047,400 | A | | 4/2000 | Spencer | |
| 6,055,666 | A | | 5/2000 | Eklund et al. | |
| 6,079,053 | A | | 6/2000 | Clover, Jr. et al. | |
| 6,119,276 | A | | 9/2000 | Newcomb et al. | |
| 6,154,881 | A | | 12/2000 | Lee | |
| 6,163,891 | A | | 12/2000 | Viitalahti | |

* cited by examiner

*Primary Examiner*—Rodney M. Lindsey
(74) *Attorney, Agent, or Firm*—Hovey Williams LLP

(57) ABSTRACT

A face guard (10) configured for protecting the face (F) of a baseball player (P) from a baseball (B) when the guard (10) is donned by the player (P) is disclosed. The face guard (10) broadly includes an open framework (12), compressible padding (14) connected to the framework (12), and a strap assembly (16) coupled to the framework (12). The framework (12) is configured to prevent a baseball (B) from contacting the face (F) of the player (P) when the guard (10) is donned by the player (P) without restricting the player's generally horizontal line of sight. The compressible padding (14) is configured to contact the player (P) and thereby space the framework (12) from the face (F) when the guard (10) is donned. The strap assembly (16) is configured to both position and retain the framework (12) on the face (F) of the player (P) when the guard (10) is donned.

14 Claims, 2 Drawing Sheets

FACE GUARD

BACKGROUND OF INVENTION

1. Field of the Invention

The present invention relates generally to equipment for protecting the face of the user. More specifically, the present invention concerns a face guard for protecting a baseball player's face from a baseball without restricting the player's generally horizontal line of sight when the guard is donned by the player.

2. Discussion of Prior Art

Baseball and softball players are at risk of being hit in the face by a moving ball. It is known in the art to protect the face of some ball players (e.g., catchers) with a face guard or mask. These catcher-type masks typically include significant padding and/or framing around the face of the user for protective purposes. As a result, catcher-type masks are bulky and tend to obstruct aspects of the player's vision. These limitations are undesirable for players other than the catcher (e.g., pitchers, infielders, etc.) and therefore catcher-type masks are problematic for their protection.

Infielder masks for ball players are known in the art and are typically less bulky than the catcher-type masks discussed above. However, these prior art infielder masks are problematic and have several limitations. For example, prior art infielder masks undesirably obstruct the player's horizontal line of sight, including the player's peripheral vision, either because the framing interferes with the player's vision when the mask is properly positioned or because the mask moves relative to the player's face during use. In addition, prior art infielder masks are uncomfortable and do not adequately protect the player's face. For example, prior art infielder masks cannot be sufficiently secured to the face to substantially absorb the impact forces of a ball engaging the mask and/or the masks are not sufficiently configured to adequately transfer the absorbed impact forces (e.g., the masks are not spaced from the face, the face is not insulated from the mask, etc.). Furthermore, prior art infielder masks are difficult to don, requiring the player to use both hands to position the mask on the face and hold it there while simultaneously adjusting the necessary straps to secure the mask to the face. These limitations are undesirable because they discourage ball players from wearing the masks thereby compromising the players' safety.

SUMMARY OF INVENTION

The present invention provides an improved face guard that does not suffer from the problems and limitations of prior art masks as set forth above. The inventive face guard provides effective yet comfortable protection for a baseball player's face from a baseball without restricting the player's generally horizontal line of sight when the guard is donned by the player. The inventive face guard can be easily and sufficiently secured to the player's face and once secured thereto remains adequately spaced and insulated from the face to substantially absorb impact forces of a ball engaging the guard without undesirably transferring the forces to protected features of the face.

A first aspect of the present invention concerns a face guard for protecting a baseball player's face from a baseball without restricting the player's generally horizontal line of sight when the guard is donned by the player. The inventive face guard broadly includes an open framework configured to prevent a baseball from contacting the player's face when the guard is donned, a plurality of straps coupled to the framework and operable to position and retain the framework on the player when the guard is donned, and compressible padding connected to the framework and configured to contact the player and thereby space the framework from the face when the guard is donned. The framework includes a plurality of vertically spaced crossbars extending across the player's face when the guard is donned and a plurality of risers interconnecting the crossbars. The framework is positioned, when the guard is donned, outside of the player's generally horizontal line of sight. The padding presents a brow pad and a chin pad. The brow pad extends laterally across the face and is configured to contact the brow of the player when the guard is donned. The chin pad extends vertically along the face and is configured to contact the chin of the player when the guard is donned. The risers are free of the padding.

A second aspect of the present invention concerns a face guard for protecting a baseball player's face from a baseball without restricting the player's generally horizontal line of sight when the guard is donned by the player. The inventive face guard broadly includes an open framework configured to prevent a baseball from contacting the player's face when the guard is donned, a plurality of straps coupled to the framework and operable to position and retain the framework on the player when the guard is donned, and compressible padding connected to the framework and configured to contact the player and thereby space the framework from the face when the guard is donned. The framework includes a plurality of vertically spaced crossbars extending across the player's face when the guard is donned and a plurality of risers interconnecting the crossbars. The framework is positioned, when the guard is donned, outside of the player's generally horizontal line of sight. The straps include a positioning strap and a securing strap. The positioning strap is continuous and stretchable and configured to extend around the player's head and thereby position the guard on the player's face when the guard is donned. The securing strap is adjustable and configured to snugly enclose the player's head and thereby secure the guard on the player's face once the guard is positioned on the player's face.

A third aspect of the present invention concerns a face guard for protecting a baseball player's face from a baseball without restricting the player's generally horizontal line of sight when the guard is donned by the player. The inventive face guard broadly includes an open framework configured to prevent a baseball from contacting the player's face when the guard is donned, a plurality of straps coupled to the framework and operable to position and retain the framework on the player when the guard is donned, and compressible padding connected to the framework and configured to contact the player and thereby space the framework from the face when the guard is donned. The framework includes a plurality of vertically spaced crossbars extending across the player's face when the guard is donned and a plurality of risers interconnecting the crossbars. The framework is positioned, when the guard is donned, outside of the player's generally horizontal line of sight. The straps include a positioning strap and first and second securing straps. The positioning strap is continuous and stretchable. The first and second securing straps are adjustable. The first securing strap is configured to secure the guard on the player's face when the guard is donned so that movement of the guard relative to the player's face in a first direction is substantially prevented. The second securing strap is configured to secure the guard on the player's face when the guard is donned so that movement of the guard relative to the player's face in a second direction is substantially prevented wherein the first and second directions are generally perpendicular to one another. The padding presents a brow pad and a chin pad. The brow pad extends laterally across the face and is configured to contact the brow of the player when the guard is donned. The chin pad extends vertically along the face and is configured to contact the chin of the player when the guard is donned.

A fourth aspect of the present invention concerns a method of protecting a baseball player's face from impact forces of a baseball without restricting the player's generally horizontal line of sight. The inventive method broadly includes the steps of positioning an open framework on the player's face so tat a plurality of vertically spaced crossbars in the framework extend across the player's face outside of the players generally horizontal line of sight; spacing the framework from the player's face with compressible padding so that the padding generally defines a first point of contact generally at the player's brow and a second point of contact generally at the player's chin; and securing the framework to the player's face so that impact forces of a baseball engaging the framework are substantially limited to the first and second points of contact.

Other aspects and advantages of the present invention will be apparent from the following detailed description of the preferred embodiment and the accompanying drawing figures.

BRIEF DESCRIPTION OF DRAWINGS

A preferred embodiment of the invention is described in detail below with reference to the attached drawing figures, wherein.

DETAILED DESCRIPTION

Figure 1:
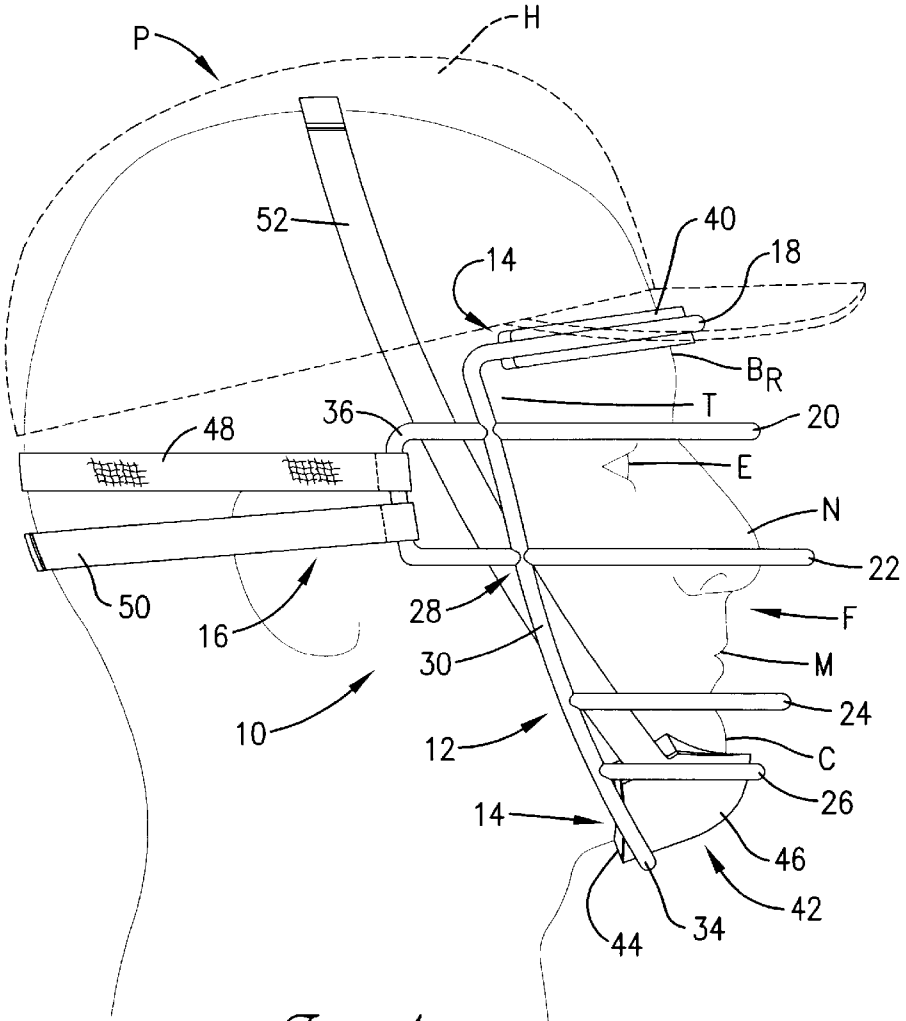
FIG. 1 is a side elevational view of a face guard constructed in accordance with a preferred embodiment of the present invention and shown donned by a baseball player also wearing a hat (shown in phantom)
Figure 4:
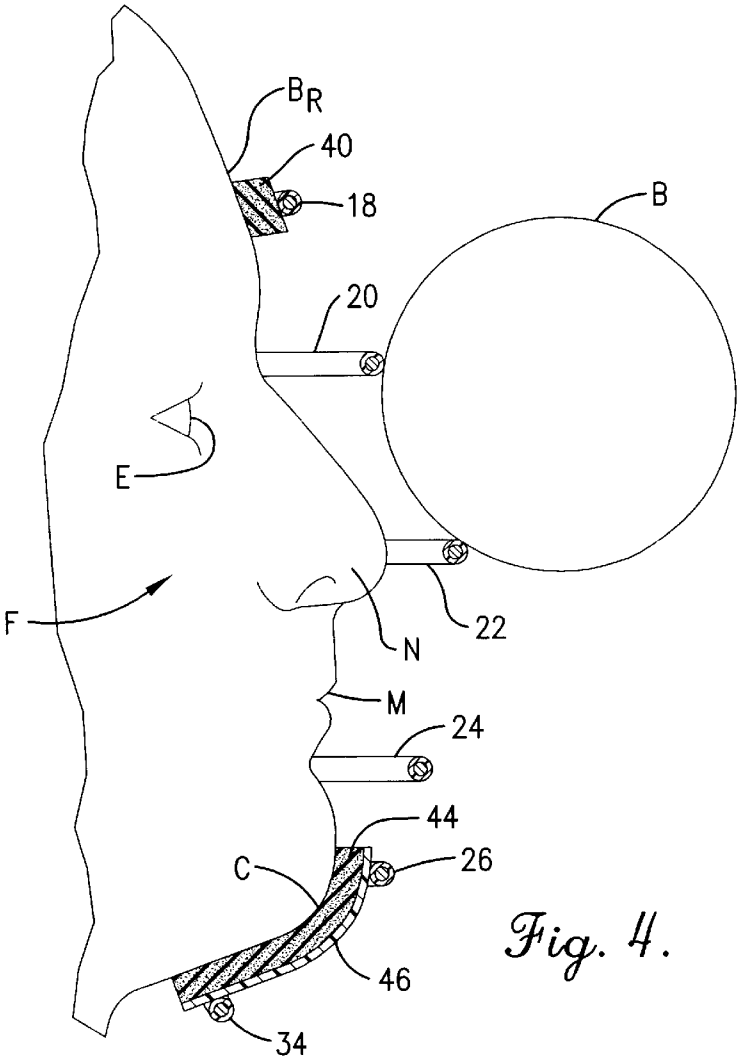
FIG. 4 is an enlarged partial sectional view of the face guard shown donned by a baseball player and engaging a baseball with the player and ball shown schematically.

FIG. 1 illustrates a face guard 10 constructed in accordance with a preferred embodiment of the present invention and configured for protecting the face F of a baseball player P from a baseball B (see FIG. 4) when the guard 10 is donned by the player P. The facial area to be protected is illustrated in FIG. 4 and generally ranges vertically from the player's brow BR down to the chin C and ranges laterally between the temples T. This area incorporates, among other features, the eyes E, the nose N, and the mouth M. Although the illustrated player P is an adult male baseball player wearing a baseball hat H, the principles of the present invention equally apply to face guards that are sized for protecting the faces of virtually any type of player (e.g., cricket, softball, etc.) regardless of age, gender, attire, etc. The face guard 10 broadly includes an open framework 12, compressible padding 14 connected to the framework 12, and a strap assembly 16 coupled to the framework 12.

In more detail, the framework 12 is configured to prevent a baseball B from contacting the face F of the player P when the guard 10 is donned by the player P. In this regard, the framework 12 includes a plurality of vertically spaced crossbars 18, 20, 22, 24, and 26. The crossbars 18,20,22,24,26 each extend across the face F of the player P when the guard 10 is donned by the player P. As shown in FIG. 4, the crossbars 18,20,22,24,26 are each vertically spaced from an immediately adjacent crossbar in such a manner that when a baseball B engages the framework 12, the baseball B is prevented from contacting the face F of the player P. It is important, however, that the crossbars 18,20,22 located adjacent the eyes E of the player P be sufficiently spaced from each other so that the player's generally horizontal line of sight is not restricted when the guard 10 is donned by the player P. The player's horizontal line of sight includes the direct path of vision from the player's eyes E extending forward therefrom as well as the peripheral area of vision extending out to either side of the direct path of vision. It is important that the crossbars 18,20,22,24,26 be configured so that when the framework 12 is positioned on the face F of the player P, the crossbars 18,20,22,24,26 are located outside of the player's generally horizontal line of sight.

Figure 2:
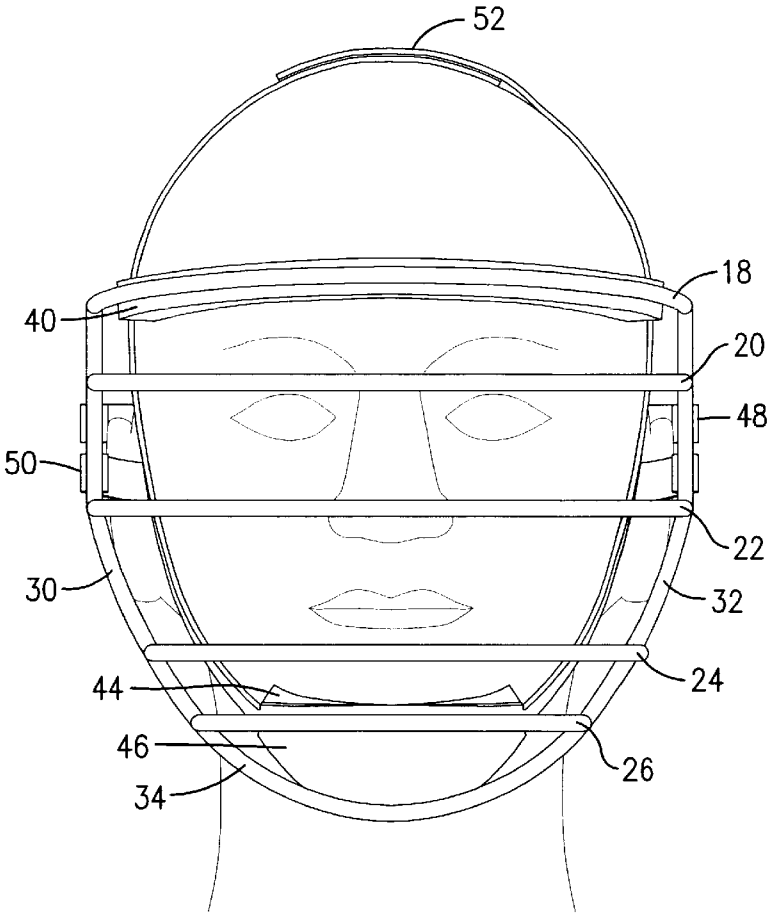
FIG. 2 is a front elevational view of the face guard shown donned by a baseball player.

The framework 12 further includes a riser assembly 28 that interconnects the crossbars 18,20,22,24,26. The illustrated riser assembly 28 includes a pair of horizontally spaced riser sections 30 and 32 and a chin bar 34 interconnecting the pair of risers 30,32 (see FIG. 2). The risers 30,32 each generally extend vertically along the face F of the player P when the guard 10 is donned. The chin bar 34 is actuate shaped and is configured to extend around and below the chin C of the player P when the guard 10 is donned. The riser assembly 28 is configured so that when the framework 12 is positioned on the face F of the player P, all of the components of the riser assembly 28 are located outside of the player's generally horizontal line of sight. Although the illustrated riser assembly 28 includes contiguous and continuous risers 30,32 that are also contiguous and continuous with the chin bar 34, it is within the ambit of the present invention to utilize a plurality of separate riser components that are neither contiguous nor continuous with each other or with the chin bar. However, it is important that none of the utilized components of the riser assembly restrict the player's generally horizontal line of sight when the framework is positioned on the player's face.

The illustrated framework 12 also includes a pair of rearwardly extending strap couplings 36 and 38. As will be subsequently described in detail, the couplings 36,38 are configured to facilitate coupling the strap assembly 16 to the framework 12. However, it is within the ambit of the present invention to utilize a framework design where the strap assembly is coupled directly to the riser assembly and/or the crossbars.

All of the above described components of the framework 12 are preferably formed of materials designed to be lightweight yet absorb the impact forces of ball in flight engaging the guard 10 to thereby lessen the impact of a ball striking the guard 10 while it is donned by the player P. For example, the framework 12 could be constructed of a high impact metal (e.g., steel or some other metal alloy) coated with an elastic substance (e.g., rubber, etc.). However, it is within the ambit of the present invention to utilize various alternative configurations, designs, materials, etc. for the framework so long as the framework prevents a baseball from contacting the player's face without restricting the player's generally horizontal line of sight. For example, the framework could utilize a transparent eye shield (e.g., formed from a synthetic polymer, etc.).

Figure 3:
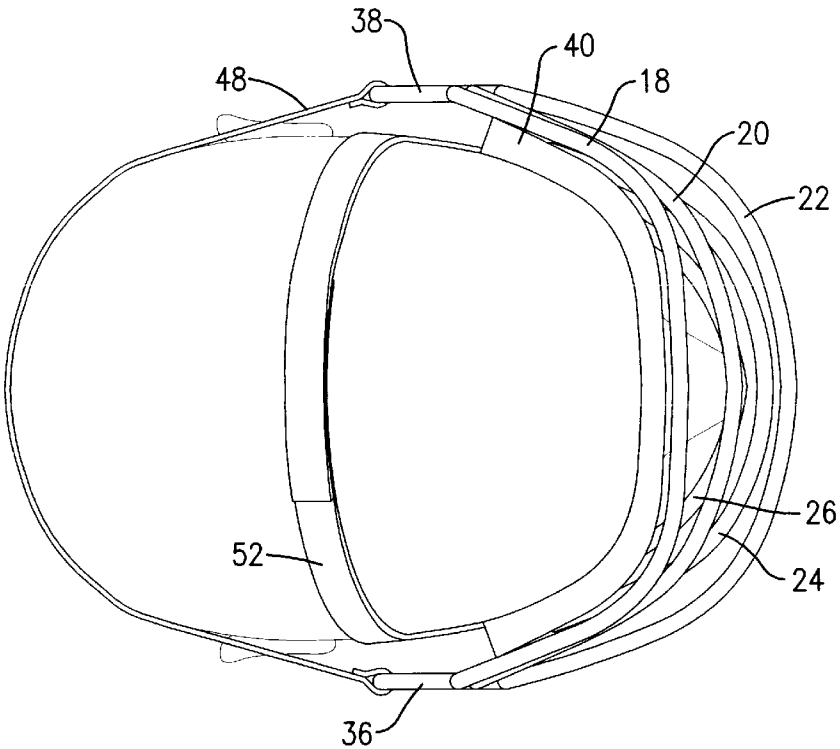
FIG. 3 is a top view of the face guard shown donned by a baseball player.

The compressible padding 14 is connected to the framework 12 and is configured to contact the player P and thereby space the framework 12 from the face F when the guard 10 is donned. In particular, the illustrated padding 14 includes a brow pad 40 and a chin pad 42. The brow pad 40 extends laterally across the face F and is configured to contact the brow BR of the player P when the guard 10 is donned (see FIG. 3). In this regard, the brow pad 40 is coupled to the inside surface of the crossbar 18 (e.g., via an adhesive, etc.). The chin pad 42 extends vertically along the face F and is configured to contact the chin C of the player P when the guard 10 is donned (see FIG. 4). In this regard, the chin pad 42 is coupled between the inside surfaces of the crossbar 26 and the chin bar 34. In particular, the chin pad 42 includes a layer of padding 44 backed by a chin guard 46. The chin guard 46 is preferably formed from a durable, ball-deflecting material (e.g., a hard plastic, a metal alloy, etc.). The chin guard 46 is fixed to the crossbar 26 and/or the chin bar 34 in any suitable manner (e.g., pivotal sleeve fit, detented snap fit, an adhesive, welded, etc.).

In addition to spacing the framework 12 from the face F, the compressible padding 14 also serves to facilitate the comfort of wear of the guard 10 as well as enhancing the impact force-absorbing function of the guard 10. In this regard, the brow pad 40 and the layer of padding 44 of the chin pad 42 are preferably formed of a compressible material (e.g., foam rubber, etc.). The compressible padding 14 preferably defines only two points of contacts with the face F. These two points of contacts are preferably located on the face F at locations having bone support (e.g., brow, chin, etc.). In this manner, the impact forces of a baseball B engaging the framework 12 that are not absorbed by the framework 12 are transferred to the padding 14 at the two points of contact defined thereby. It is further important that the compressible padding 14 does not restrict the player's generally horizontal line of sight. In these regards, the illustrated risers 30,32 do not have any compressible padding 14 coupled thereto. It is within the ambit of the present invention to utilize various alternative configurations, designs, materials, etc. for the compressible padding so long as the compressible padding spaces the framework from the face and does not restrict the player's generally horizontal line of sight.

The strap assembly 16 is coupled to the framework 12 and is configured to position and retain the framework 12 on the face F of the player P when the guard 10 is donned. In particular, the illustrated strap assembly 16 includes a positioning strap 48, a securing strap 50 and an anchoring strap 52. The positioning strap 48 is fixed at each end to a respective strap coupling 36,38 (e.g., by stitching, etc.) (see FIGS. 1 and 3). The positioning strap 48 is continuous between its ends and stretchable (e.g., formed of an elastic-type material having elastomeric threading woven therein). The positioning strap 48 is configured to extend around the head of the player P and thereby position the guard 10 on the face F of the player P when the guard 10 is donned. When the guard 10 is donned by the player P, the positioning strap 48 holds the guard 10 in position without requiring the player P to steady and/or position the guard 10 with his hands. In this manner, the hands of the player P are free to adjust the remaining straps 50,52. The securing strap 50 is also fixed at its ends proximate the framework 12 to respective strap couplings 36,38. The securing strap 50, unlike the positioning strap 48, is adjustable. In this regard, the securing strap 50 includes a second set of ends distal to the framework 12 that are removably and adjustably connectable. In the illustrated guard 10, the distal ends of the securing strap 50 each include complementary portions of a hook and loop fastener (e.g., velcro, etc.), however, the distal ends could be joined by various adjustable methods known in the art (e.g., buckles, clamps, etc.). The securing strap 50, once adjusted, is configured to snugly enclose the head of the player P and thereby firmly secure the guard 10 on the face F of the player P once the guard 10 is positioned on the player P.

The anchoring strap 52, like the securing strap 50, is configured to firmly secure the guard 10 on the face F of the player P once the guard 10 is positioned on the player P. The anchoring strap 52 is fixed at its ends proximate the framework 12 to the chin guard 46. However, it is within the ambit of the present invention to utilize various alternative configurations for coupling the anchoring strap to the guard 10 (e.g., it could be coupled to the framework, etc.). The anchoring strap 52, like the securing strap 50, is adjustable. In this regard, the anchoring strap 52 includes a second set of ends distal to the framework 12 that are removably and adjustably connectable. In the illustrated guard 10, the distal ends of the anchoring strap 52 each include complementary portions of a hook and loop fastener (e.g., velcro, etc.), however, the distal ends could be joined by various adjustable methods known in the art (e.g., buckles, clamps, etc.). The illustrated anchoring strap 50, once adjusted, is configured to snugly enclose the crown of the head of the player P and thereby firmly secure the guard 10 on the face F of the player P once the guard 10 is positioned on the player P. The securing and anchoring straps 50,52 cooperate to substantially prevent the framework 12 from undesired movement relevant to the face F of the player P. In this regard, the securing strap 50 is configured to secure the guard 10 on the player's face F when the guard 10 is donned so that movement of the guard 10 away from the player's face F in a forward direction is substantially prevented. The anchoring strap 52 is configured to secure the guard 10 on the player's face F when the guard 10 is donned so that movement of the guard 10 along the player's face F in a downward direction is substantially prevented. The forward and downward directions are generally perpendicular to one another. It will be appreciated that the strap assembly 16 does not prevent all movement of the guard 10 relative to the face F. However, it is important that the strap assembly 16 maintain the framework 12 against the face F so that the compressible padding 14 remains in contact with the face F and that the framework 12 does not move into the player's generally horizontal line of sight.

The illustrated securing and anchoring straps 50,52 are formed from a nylon material that is preferably less stretchable than the positioning strap 48. However, it is within the ambit of the present invention to utilize various alternative configurations, designs, materials, etc. for the strap assembly 16. It is important that at least one of the straps is configured to quickly position the guard on the player without requiring the use of the player's hands to support and position the guard while adjusting this strap and that at least one additional strap be adjustable to firmly secure the guard on the player.

The preferred forms of the invention described above are to be used as illustration only, and should not be utilized in a limiting sense in interpreting the scope of the present invention. Obvious modifications to the exemplary embodiment, as hereinabove set forth, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A face guard for protecting a baseball player's face from a baseball without restricting the player's generally horizontal line of sight when the guard is donned by the player, the face guard comprising:

an open framework configured to prevent a baseball from contacting the player's face when the guard is donned, said framework including a plurality of vertically spaced crossbars extending across the player's face when the guard is donned, said framework further including a plurality of risers interconnecting the crossbars, said framework being positioned, when the guard is donned, outside of the player's generally horizontal line of sight;

a plurality of straps coupled to the framework and operable to position and retain the framework on the player when the guard is donned; and compressible padding connected to the framework and configured to contact the player and thereby space the framework from the face when the guard is donned, said padding presenting a brow pad and a chin pad, said brow pad extending laterally across the face and configured to contact the brow of the player when the guard is donned, said chin pad extending vertically along the face and configured to contact the chin of the player when the guard is donned, said risers being free of said padding, said framework including a chin bar extending below the chin of the player when the guard is donned, said framework including a chin guard, said plurality of straps including a stretchable positioning strap and first and second adjustable securing straps.

2. The face guard as claimed in claim 1, said chin guard being coupled between the chin bar and the chin pad.

3. The face guard as claimed in claim 1, each of said plurality of risers being contiguous with at least one other riser.

4. The face guard as claimed in claim 3, said plurality of risers being integrally formed.

5. The face guard as claimed in claim 4, said chin bar being integrally formed with said plurality of risers.

6. The face guard as claimed in claim 1, said brow pad being connected to one of said crossbars.

7. A face guard for protecting a baseball player's face from a baseball without restricting the player's generally horizontal line of sight when the guard is donned by the player, the face guard comprising:

an open framework configured to prevent a baseball from contacting the player's face when the guard is donned, said framework including a plurality of vertically spaced crossbars extending across the player's face when the guard is donned, said framework further including a plurality of risers interconnecting the crossbars, said framework being positioned, when the guard is donned, outside of the player's generally horizontal line of sight;

a plurality of straps coupled to the framework and operable to position and retain the framework on the player when the guard is donned, said straps including a positioning strap and a securing strap, said positioning strap being continuous and stretchable and configured to extend around the player's head and thereby position the guard on the player's face when the guard is donned, said securing strap being adjustable and configured to snugly enclose the player's head and thereby secure the guard on the player's face once the guard is positioned on the player's face; and compressible padding connected to the framework and configured to contact the player and thereby space the framework from the face when the guard is donned, said framework including a chin bar extending below the chin of the player when the guard is donned, said framework including a chin guard, said compressible padding including a brow pad extending laterally across the face and configured to contact the brow of the player when the guard is donned, said compressible padding further including a chin pad extending vertically along the face and configured to contact the chin of the player when the guard is donned, said chin pad being integrally formed with said chin guard, said plurality of straps including an additional adjustable securing strap.

8. The face guard as claimed in claim 7, said additional securing strap being coupled to the chin guard and being configured to snugly enclose the crown of the player's head and thereby secure the guard on the player's face once the guard is positioned on the player's face.

9. The face guard as claimed in claim 8, said plurality of risers being free of said compressible padding.

10. A face guard for protecting a baseball player's face from a baseball without restricting the player's generally horizontal line of sight when the guard is donned by the player, the face guard comprising:

an open framework configured to prevent a baseball from contacting the player's face when the guard is donned, said framework including a plurality of vertically spaced crossbars extending across the player's face when the guard is donned, said framework further including a plurality of risers interconnecting the crossbars, said framework being positioned, when the guard is donned, outside of the player's generally horizontal line of sight;

a plurality of straps coupled to the framework and operable to position and retain the framework on the player when the guard is donned, said straps including a positioning strap and a first securing strap, said positioning strap being continuous and stretchable, said first securing strap being adjustable; and compressible padding connected to the framework and configured to contact the player and thereby space the framework from the face when the guard is donned, said padding presenting a brow pad and a chin pad, said brow pad extending laterally across the face and configured to contact the brow of the player when the guard is donned, said chin pad extending vertically along the face and configured to contact the chin of the player when the guard is donned, said plurality of straps including a second securing strap being adjustable, said first securing strap being configured to secure the guard on the player's face when the guard is donned so that movement of the guard relative to the player's face in a first direction is substantially prevented, said second securing strap being configured to secure the guard on the player's face when the guard is donned so that movement of the guard relative to the player's face in a second direction is substantially prevented wherein the first and second directions are generally perpendicular to one another.

11. The face guard as claimed in claim 10, said plurality of risers being free of said compressible padding.

12. The face guard as claimed in claim 11, said framework including a chin bar extending below the chin of the player when the guard is donned.

13. The face guard as claimed in claim 12, said framework including a chin guard coupled between the chin pad and the chin bar.

14. The face guard as claimed in claim 13, said second securing strap being coupled to the chin guard.

* * * * *